United States Patent [19]

Lindholm

[11] Patent Number: 4,497,660

[45] Date of Patent: Feb. 5, 1985

[54] CEMENTED CARBIDE

[75] Inventor: Leif Lindholm, Hägersten, Sweden

[73] Assignee: Santrade Limited, Lucerne, Switzerland

[21] Appl. No.: 589,037

[22] PCT Filed: May 14, 1980

[86] PCT No.: PCT/SE80/00141

§ 371 Date: Jan. 15, 1981

§ 102(e) Date: Jan. 15, 1981

[87] PCT Pub. No.: WO80/02569

PCT Pub. Date: Nov. 27, 1980

Related U.S. Application Data

[63] Continuation of Ser. No. 230,943, Jan. 15, 1981, abandoned.

[30] Foreign Application Priority Data

May 17, 1979 [SE] Sweden ..... 7904331

[51] Int. Cl.[3] ..... C22C 29/00

[52] U.S. Cl. ..... 75/240; 75/236; 75/242

[58] Field of Search ..... 75/240, 236, 242

[56] References Cited

U.S. PATENT DOCUMENTS

| | | | |
|---|---|---|---|
| 2,147,329 | 2/1939 | Willey | 75/240 |
| 3,215,510 | 11/1965 | Kelly et al. | 75/240 |
| 3,322,513 | 5/1967 | Corbett | 75/237 |
| 3,677,722 | 7/1972 | Rymas | 75/240 |
| 3,746,519 | 7/1973 | Hara et al. | 75/240 |
| 3,816,081 | 6/1974 | Hale | 75/240 |
| 3,993,446 | 11/1976 | Okawa | 75/240 |

*Primary Examiner*—Mark Bell

*Attorney, Agent, or Firm*—Burns, Doane, Swecker & Mathis

[57] ABSTRACT

In material applications in which besides a high wear resistance also excellent corrosion resistance, strength and toughness are required, conventional hard metal alloys have appeared inadequate. According to the invention a hard metal alloy now exists which fulfils these requirements. It is based on WC-Ni, and the binder phase of nickel is alloyed with low, well adjusted concentrations of above all Cr and Mo.

5 Claims, 1 Drawing Figure

CEMENTED CARBIDE

Figure 1:
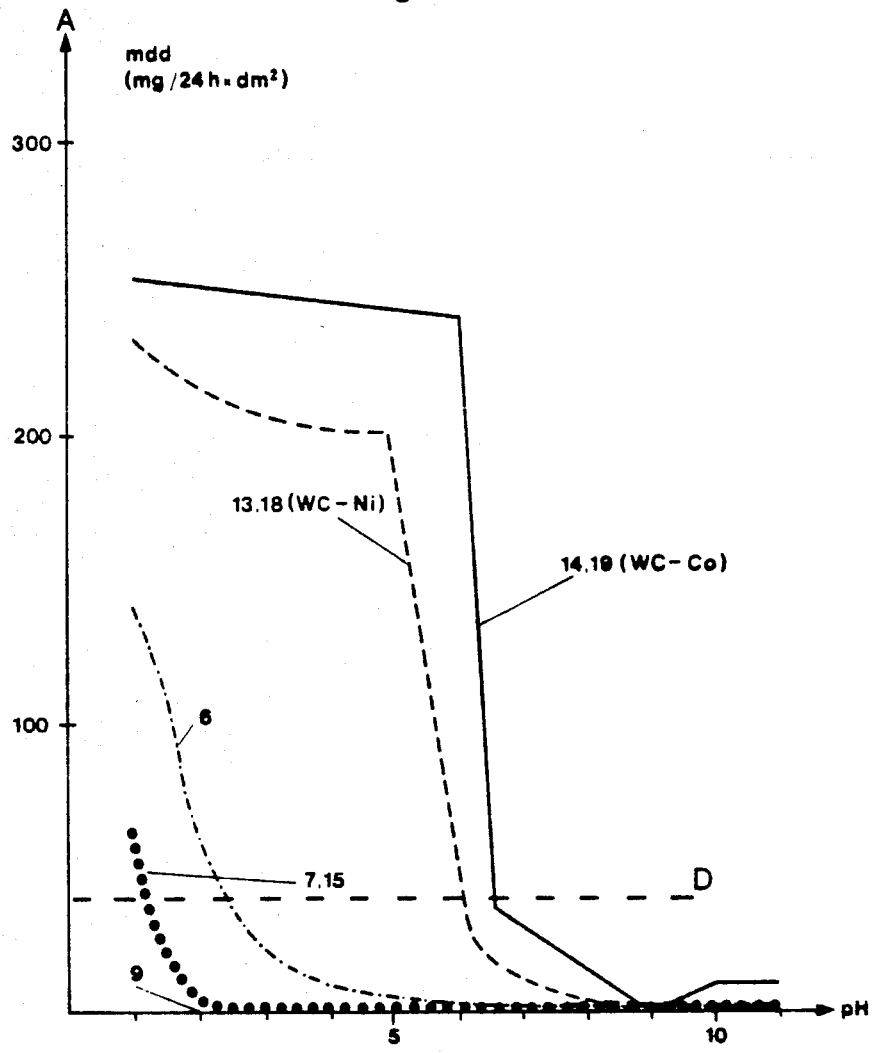

This application is a continuation of application Ser. No. 230,943, filed Jan. 15, 1981, now abandoned.

The present invention relates to a new type of hard metal with excellent properties especially when used for construction parts and wear parts but also as cutting tools and in rock drilling. More exactly the invention relates to a sintered hard metal alloy, in which the hard material principally is tungsten carbide (WC), and the binder phase is based on Ni with optimized additives of above all the elements Cr and Mo.

Since a long time hard metal, in which the hard material consists mainly of WC and the binder phase of Co, dominates when used in said applications. Principally in applications for high temperatures it has been favourable substituting WC for one or more of the carbides where Ti, V, Cr, Nb, Hf, Mo and Ta are the metal components. When high oxidation resistance or high corrosion resistance is demanded, hard metal with TiC or $Cr_3C_2$ as main component of the hard material and with a binder phase having Ni as main component, has been commercially used in rare applications. This in spite of the fact that the latter types of hard metal from a general point of view have got unfavourable properties of toughness.

Hard metal of the type in which WC is the hard material but the binder phase consists of Ni has hitherto had only a limited use. Principally it is used in certain applications in the nuclear power industry where WC-Co cannot be used because of Co-isotopes of long half-lives.

However, metallic Ni has several advantages, with respect to properties, over metallic Co. Thus, both the oxidation resistance and the corrosion resistance are better because of the higher electropotential of Ni than of Co in most reagences. Furthermore, Co is around 10 times more expensive than Ni (Nov. 78) and the mean occurrence of Ni in the earth crust is around 4 times larger than the occurrence of Co.

Ni is used as an alloying material in Co-alloys because of the higher corrosion resistance and oxidation resistance of Ni. This indicates especially favourable properties of Ni-bound hard metal. This is especially valid in applications in critical working environments under reducing or oxidation conditions. Furthermore, a long life, often for years, is a necessary demand for an economically favourable use of an expensive hard metal part compared with for example a steel part, which is much cheaper.

The physical and mechanical properties of hard metal where WC is the main component of the hard materials, are characterized mainly by the mean grain size of WC, by the concentration of binder phase and the composition of the binder phase. For hard metals the highest E-module, the lowest coefficient of thermal expansion and the highest thermal conductivity have hitherto been obtained when WC is the hard material. Furthermore, the highest toughness and a very favourable strength have been obtained for pure WC-Co hard metal. Generally the elasticity module of hard metal is influenced mainly by the composition and amount of the hard material and for comparable elasticity modules the transverse rupture strength is a good measure of the general properties of toughness of the hard metal. The hardness, the resistance of the material to plastic deformation, is a measure of strength.

It is earlier known that for additives of Cr and Ni, respectively, to the binder phase of Wc-Co hard metal, which gives improved oxidation and corrosion resistances, a decrease of especially the toughness is obtained for Cr additives, whereas additives of Ni result in decrease of both toughness and strength. Additives of Cr in greater concentrations can furthermore lead to difficulties in controlling the carbon balance in sintered hard metal and to the formation of brittle double carbides in which the binder phase metals are components, which will result in drasticly decreased toughness. Additives of Fe cause still lower toughness than additives of Ni.

Thus, it is well known that for hard metal with WC as main component of the hard material the alternative with Co in the binder phase is favourable principally from a toughness point of view. Especially for construction parts and wear parts the toughness properties of WC-Co hard metal are the fundamental properties which besides a good wear resistance have led to that hard metal has successfully been able to compete with materials as hard as hard metal and in certain cases very much cheaper materials, such as ceramic.

However, the stated type of hard metal has got relatively limited corrosion resistance. The most common type of corrosion damages on WC-Co hard metal involves a general corrosion of the ductile binder phase, which is dissolved, and only a brittle WC-skeleton remains in the attacked area. This type of damage means that a dangerous indication of fracture has been created involving a catastrophic decrease of the real toughness of the detail. When increased corrosion resistance or oxidation resistance is demanded, hard metal of a different type than WC-Co is therefore used in certain cases, but because of the inferior properties of toughness and wear resistance of these types the advantage of using hard metal compared to cheaper materials decreases. A hard metal type of improved corrosion resistance and oxidation resistance which has also got a good toughness is up to now missing.

When high toughness of the hard metal is needed and at the same time a high corrosion resistance is demanded for a certain application, constructions, where corrosion preventing water which is led past the detail is protecting the detail of the corrosive medium, are utilized in exceptional cases. In certain other cases sacrificial anodes have been placed near the hard metal detail and protect the latter one of corrosion by consuming themselves. The material of the anode is chosen to have a lower electropotential than the hard metal in the present environment. In closed systems corrosion inhibitors can in certain cases be added to the system and inhibit the corrosion. All these up to now available ways of meeting high demands of toughness and corrosion resistance of the hard metal require adjustments of the construction to each specific working environment and will consequently be expensive. Also the constructions will be complicated when for instance pure corrosion preventing water must be supplied by a special system of pumps and systems for supervision are necessary. Small changes of the working environment which often occur in practical working, such as acidifying of process media, can destroy the function of the construction. This can cause a drastic increase of the speed of consumption of the anode material or that added inhibitors will be without effect.

According to the present invention a new type of hard metal now exists, which besides a very high wear resistance has got at least the good properties of toughness and strength of the WC-Co hard metal grades and which furthermore has got very good corrosion and oxidation resistances. This new hard metal type has properties to fill the hitherto lack of grades when both high toughness and high corrosion and oxidation resistances are required. This is valid without developing special constructions for the protection of the construction part or wear part. The hard metal type, whose content of alloying elements and structural constituents is near a well known range, per se, obtains its surprisingly good properties by balanced proportions of alloying elements and, by extremely controlled production, optimized structural constituents.

The alloy consists of 55–95 vol-% hard material which essentially is WC, more than 90 vol% and preferably more than 95 vol%, but also carbides in which the metal content is Ti, Zr, Hf, V, Nb and Ta, can be included in an amount of at most 10 vol-%. The hard material is preferably composed of WC to minimum 98 vol-%. Thus, the binder phase, which comprises the remaining structural constituent, comprises 5–45 vol-% of the hard metal. The binder phase comprises suitably between 8–40 vol-% of the hard metal. The main constituent of the binder phase is Ni, which comprises minimum 50 vol-%, suitably more than 60 vol-%. The binder phase contains different alloying elements in solution and consists, besides of Ni, of 2–25% Cr, 1–15% Mo, max. 10% Mn, max. 5% Al, max. 5% Si, max. 10% Cu, max. 30% Co, max. 20% Fe and max. 13% W. (All the figures relate to vol-% of the binder phase.) Co and Fe substitute Ni in the binder phase and W is obtained from the hard material during sintering and its concentration is controlled by regulating the total carbon concentration of the hard metal in the grinding operation. Suitably the concentration of W in the binder phase should not exceed 8 vol-% of the sintered hard metal. The alloying elements, which are dissolved in the binder phase, can be classified into groups with respect to their influence on the properties of the hard metal. Co or Fe, respectively, can in certain cases be included in concentrations up to 20 or 10 vol-%, respectively, in the binder phase and will substitute Ni without deteriorating the surprisingly good properties.

It is necessary to add Cr in concentrations of 2–20 vol-% and Mo in concentrations of 1–6 vol-% of the totally added amount of binder phase in order to obtain the favourable properties. For additions of Cr in concentrations of 10–25 vol-% and concentrations of Mo of 3–15 vol-%, where Cr+Mo together comprise at least 20 vol-% of the binder phase or where Mo comprises more than 6 vol-% of the binder phase, also Al in concentrations of 0.5–5.0 vol-%, Si in concentrations 0.5–5.0 vol-% or Cu in concentrations 0.5–10 vol-% must be added to the binder phase. Surprisingly, Al, Si or Cu of these concentrations have got a stabilizing influence on the binder phase of this type of hard metal. If Al, Si or Cu are not added for the chromium and molybdenum concentrations given above, brittle phases are formed in the hard metal during sintering.

The amount of added Cr+Mo in the binder phase should not exceed 30 vol-% of the latter one in order to retain the favourable properties. In certain cases, principally concerning solution hardening of the binder phase, it can be advantageous partly substituting Ni and Cr by Mn, suitably in concentrations up to 8 vol-% of the added amount of binder phase. The concentration of added chromium must not be below 3 vol-% of the added amount of binder phase in order to retain the favourable properties.

Completely determining for obtaining the good toughness properties is, besides the interval given above for the content of Cr+Mo, that the total concentration of carbon of the sintered hard metal is kept within a narrow interval. This condition must be fulfilled in order to obtain a single phase and tough binder phase and in order to prevent the formation of brittle carbides. The carbon concentration is influenced as well by the concentration of carbides and the type of carbides as by the concentration of added Cr+Mo. The following interval has been optimal when the hard material comprises only WC:

| | |
|---|---|
| w/o C = $A_1$–$B_i$ × (100 minus w/o hard material) | |
| for pure WC: $A_i$ = 6.13 | For Cr + Mo between 3–15 vol-%, $B_i$ = 0.061 ± 0.008 |
| (w/o C = total carbon concentration of sintered hard metal) | For Cr + Mo between 16–35 vol-%, $B_i$ = 0.058 ± 0.007 |

For pure WC-Ni hard metal a two-phase structure can be obtained in the following interval: $A_i$=6.13, B=0.069±0.010. For the case that besides WC also other carbides are included as hard material, the value of $A_i$ must be corrected according to the example below, where $A_i$ is the stoechiometric carbon concentration of each carbide, in w/o.

| Hard material | $A_i$ | |
|---|---|---|
| WC | 6.13 | $A_i$ = 1/100 (w/o WC in hard material × |
| TaC | 6.22 | 6.13 + w/o TaC in hard material × |
| VC | 19.08 | 6.22 + w/o VC in hard material × 19.08) |

For hard material compositions according to the invention, i.e. at least 90 vol-% WC, the B-value according to the case with solely WC as hard material can with advantage be used. The interval given above for the total carbon concentration of the sintered hard metal involves, compared with pure WC-Ni hard metal, that the available interval for obtaining a single phase binder phase has been shrunk and displaced to a higher concentration of carbon with respect to the present WC-concentration in order to obtain the favourable properties.

According to experience of development of WC-Co hard metal the toughness can be influenced only by displacing the strength in the opposite direction. An increased concentration of binder phase, alternatively a coarser mean grain size of WC, increases the toughness but causes decreased strength. These are hitherto the only known methods to improve the toughness provided that the hard metal structure from a general point of view is without objection. It is also known that the alloying of the Co binder phase without exceptions causes deteriorated toughness but often also decreased strength.

It is therefore very surprising that additives of Cr and Mo to WC-Ni hard metal according to the present invention cause both increased toughness and increased strength. Both Cr and Mo, from a thermo-dynamical point of view, are known as around as strong carbide stabilizers as W and therefore would be supposed to stabilize a formation of double carbides. These are very brittle and should therefore cause a brittle hard metal. In the exceptional cases in which chromium and/or molybdenum additives have been previously used to hard metal with Ni binder phase, the additives must have been done with the purpose of increasing the corrosion and oxidation durabilities of the hard metal. Such alloys are reported in among others the Japanese publications (Kokai) 50-45708, 50-120410 and 50-27707. The additions have been great, however, too great for discovering the favourable influence of these alloying elements on toughness and strength. The alloying concentration has often been as great as the concentration of Ni or even greater, which has involved that a multiphase and brittle binder phase has been obtained. The bad general properties above all bad toughness, which the hard metal has obtained in normal production and which also is due to bad wetting between the carbide phase and the multi-phase binder phase, have obviously been accepted as this was in accordance with knowledge obtained in development of WC-Co hard metal.

It can be somewhat surprising that lower concentrations in alloying with chromium and molybdenum have not been previously used. However, it is well known from the development of stainless steels that additives of for instance chromium below a threshold value which practically is around 13 w/o chromium, will increase the corrosion attacks on the steel. When also carbon is present, as in hard metal, this threshold value is further increased. As is obvious from tests with the present invented hard metal (cf. Example 2) this rule is not valid for alloying of the binder phase in the present case.

It is previously known that if chromium and molybdenum are added each separately to WC-Ni hard metal, this results in a decreased toughness also for low alloying concentrations. Besides, the importance of the carbon concentration for especially favourable toughness properties has not previously been noticed for the present type of alloy.

It is known, however, that solely molybdenum, often added as Mo-carbide $Mo_2C$, has got a certain positive influence on the toughness properties of TiC-Ni hard metal, which is very brittle and has low wear resistance compared to WC-Co hard metal. However, the Mo-concentrations which are actual for the alloy according to the invention, are only about one tenth of the optimum concentration for TiC-Ni hard metal, and also other essential differences between TiC-Ni hard metal and WC-Ni hard metal exist.

The reason for the good toughness and strength properties of the alloy according to the invention is probably an interaction of the influence of chromium and molybdenum on carbide phase and binder phase. Analysis of the constituents of the hard metal shows that Mo is alloyed in both the carbide phase and the binder phase whereas Cr principally is alloyed in the binder phase. The relatively high carbon concentration of sintered hard metal is necessary to keep the alloying amount of tungsten in the binder phase low in order to prevent the formation of brittle double carbides. Mechanical data for the invented hard metal show that the good strength principally is due to a strong alloying hardening by the chromium addition. A low alloying of Mo in the carbide phase together with alloying of Mo and Cr in the binder phase result in a very good wetting between carbide phase and binder phase resulting in a very favourable toughness.

The difference in hardness, which exists from a general point of view between "not alloyed" WC-Co and WC-Ni hard metal, proves the weak solution hardening ability of tungsten in Ni-bound hard metal. The alloying of tungsten in the binder phase is therefore kept low for the present invention by now actual carbon balance relations and additives of aluminium, silocon or copper.

Among the prepared binder phase compositions which appear extremely suitable to obtain the favourable toughness properties and also a very good oxidation resistance and corrosion resistance, the following analyses could be noticed, 1. 5–15 vol% Cr, 1.5–6 vol% Mo where the amount of Cr+Mo does not exceed 20 vol%, Co up to 5, Fe up to 3 and W up to 8 vol% and the rest Ni, where in Ni also normally occurring low concentrations of impurities are present.
2. 15–25 vol% Cr, 3–10 vol% Mo, where the amount of Cr+Mo is in the range of 20–30 vol%, Al in concentrations of 0.5–5 vol% or Cu in concentrations of 0.5–8 vol%, Co up to 10, Fe up to 5 vol%, W up to 7 vol% and the rest Ni, where in Ni also normally occurring low concentrations of impurities are present.

Provided that the total carbon concentration of sintered hard metal is within the range of the invention, an especially favourable toughness is obtained for binder phase no. 1, whereas an especially favourable strength and favourable oxidation resistance and corrosion resistance are obtained for binder phase no. 2.

The hard metal according to the invention is produced by powder metallurgy methods. Pure elements, hard materials and master alloys of parts of or of the complete binder phase, everything as powder, are the raw materials. The powder raw materials are usually ground in a milling equipment suitable to the hard metal industry. Milling liquids without oxygen, such as benzene or xylol, are advantageously used to minimize the take up of oxygen by the powder during grinding. High concentrations of oxygen make the necessary control of the total carbon concentration of sintered hard metal difficult. In certain cases, however, alcohol or acetone can be used as milling liquid. The powder is dried by evaporating the milling liquid at elevated temperature in a suitable inert atmosphere and is cooled to room temperature in this inert atmosphere to avoid oxidation of the powder. Sintering of the hard metal powder to a dense material and to the right constitution of structural constituents is suitably performed by so called direct sintering of a coldpressed powder body. Presintering, in which substances added in the grinding to aid in pressing are evaporated, and final sintering, in which the powder body shrinks to a dense material, is performed in one sequence. By this sintering procedure, the total carbon concentration of the sintered material can be controlled in a satisfactory way, as among other things reoxidation of the powder body after separate presintering is avoided.

EXAMPLE 1

A number of hard metal variants comprising alloys as well within as outside the composition range according to the invention, were prepared for comparative investigations. The alloying elements, the main component of the binder phase, graphite added if necessary, and hard materials according to Table 1 below, everything as powder, were ground in a ball mill. The grinding liquid was benzene and as grinding bodies hard metal balls were chosen. To minimize the take up of oxygen in the pulp, the grinding was carried out under overpressure of nitrogen. A grinding time of around 200 h for a size of the powder batch of 5 kg resulted in a well-mixed powder of suitable grain size.

The powder was dried by evaporating the grinding liquid at an elevated temperature in an inert atmosphere, such as nitrogen. The powder was cooled to room temperature in this inert atmosphere to minimize oxidation of the powder.

phase in the hard metal and to desired grain size of the tungsten carbide. A holding time of one to two hours and a sintering temperature of between 1410° C. and 1550° C. were suitable for the alloy according to the invention. The pre-sintering (if necessary) at a temperature of up to around 500° C. was advantageously performed in hydrogen whereas the final sintering was performed in vacuum.

TABLE 1

| Variant | Hard material vol-% Amount in hard metal | Hard material Composition | Binder phase vol-% Amount in hard metal | Composition | Carbon concentration prepared w/o | sintered w/o | Sintering data Temp/time |
|---|---|---|---|---|---|---|---|
| 1 | 92 | 100WC | 8 | 82Ni, 6Cr 2Mo | 6.04 | 5.86 | 1550° C./ |
| 2 | 92 | " | 8 | 85Ni, 11Cr 4Mo | 6.04 | 5.85 | " |
| 3 | 92 | " | 8 | 70Ni, 15Co, 11Cr, 4Mo | 6.04 | 5.86 | 1550° C./ |
| 4 | 92 | " | 8 | 100Ni | 5.97 | 5.84 | 1550° C./ |
| 5 | 92 | " | 8 | 100Co | 5.97 | 5.84 | 1500° C./ |
| 6 | 85 | " | 15 15 | 92Ni, 6Cr, 2Mo | 5.73 | 5.60 | 1500° C./ |
| 7 | " | " | 15 | 85Ni, 11Cr, 4Mo | 5.73 | 5.60 | " |
| 8 | " | " | 15 | 73Ni, 15Cr, 12Mo | 5.73 | 5.62 | " |
| 9 | " | " | 15 | 73Ni, 19Cr, 6Mo, 2Al | 5.76 | 5.63 | " |
| 10 | " | " | 15 | 63Ni, 21Cr, 9Mo, 7Cu | 5.76 | 5.63 | " |
| 11 | " | " | 15 | 85Ni, 15Cr | 5.76 | 5.61 | " |
| 12 | " | " | 15 | 85Ni, 15Mo | 5.76 | 5.59 | " |
| 13 | " | " | 15 | 100Ni | 5.65 | 5.57 | " |
| 14 | " | " | 15 | 100Co | 5.65 | 5.58 | 1450° C./ |
| 15 | 70 | " | 30 | 85Ni, 11Cr, 4Mo | 5.10 | 5.02 | 1400° C./ |
| 16 | " | " | 30 | 73Ni, 19Cr, 6Mo, 2Al | 5.10 | 5.03 | " |
| 17 | " | " | 30 | 55Ni, 30Cr, 9Mo, 6Al | 5.15 | 5.07 | " |
| 18 | " | " | 30 | 100Ni | 5.03 | 4.95 | " |
| 19 | " | " | 30 | 100Co | 5.03 | 4.95 | 1350° C./ |

The sintering of the hard metal powder to a dense material and to the right constitution of the structural constituents, was performed by so called direct sintering of a cold-pressed powder body. The pre-sintering, in which substances added, if necessary, in the grinding to aid in pressing are evaporated, and the final sintering, in which the powder body shrinks to a dense material, were carried out in one sequence. The sintering temperature and the time were suited to the amount of binder The oxygen concentration after grinding and drying could be kept lower than 0.7 w/o in all variants except var. 17, whereas var. 17 had an oxygen concentration of 0.91 w/o. (As is previously known, nickel binder phase requires, compared with the same amount of Co-binder phase, around 50° C. higher sintering temperature to obtain an objectionfree hard metal.)

Metallographic and physical data and results of mechanical tests are given in table 2 below:

TABLE 2

| Variant | WC grain size, mean (μm) | Hardness HV3 | Transverse rupture strength $N/mm^2$ | E-module $kN/mm^2$ | Toughness (Energy to breakage) J | Fracture toughness $K_{IC}$ $MN/m^{3/2}$ | Wear resistance Relative value var. 19 = 100 |
|---|---|---|---|---|---|---|---|
| 1 | 1.5–1.8 | 1590 | 2600 | 640 | 1.5 | 11.0 | 1000 |
| 2 | " | 1620 | 2550 | " | 1.6 | 11.0 | 1200 |
| 3 | " | 1600 | 2500 | " | 1.5 | 10.5 | 1150 |
| 4 | " | 1440 | 1900 | " | 0.7 | 8.0 | 600 |
| 5 | " | 1590 | 2400 | " | 1.1 | 10.0 | 900 |
| 6 | 1.7–2.0 | 1360 | 3200 | 600 | 3.2 | 15.0 | 600 |
| 7 | " | 1380 | 3200 | " | 3.3 | 15.0 | 600 |
| 8 | " | 1410 | 2100 | " | 1.8 | 9.5 | 400 |
| 9 | " | 1450 | 3100 | " | 3.2 | 14.5 | 750 |
| 10 | " | 1460 | 3000 | " | 3.2 | 13.5 | 800 |
| 11 | " | 1350 | 2200 | " | 1.9 | 9.5 | 450 |
| 12 | " | 1190 | 2100 | " | 1.8 | 9.5 | 370 |
| 13 | " | 1180 | 2400 | " | 2.1 | 10.5 | 370 |

TABLE 2-continued

| Variant | WC grain size, mean (μm) | Hardness HV3 | Transverse rupture strength N/mm² | E-module kN/mm² | Toughness (Energy to breakage) J | Fracture toughness $K_{IC}$ MN/m$^{3/2}$ | Wear resistance Relative value var. 19 = 100 |
|---|---|---|---|---|---|---|---|
| 14 | " | 1350 | 3000 | " | 3.1 | 13.5 | 520 |
| 15 | 1.7–2.0 | 1050 | 3000 | 500 | 5.2 | 23.0 | 130 |
| 16 | " | 1120 | 2900 | " | 5.1 | 22.5 | 140 |
| 17 | " | 1125 | 2000 | " | 3.2 | 14.0 | 90 |
| 18 | " | 900 | 2300 | " | 3.5 | 17.0 | 70 |
| 19 | " | 1030 | 2800 | " | 4.8 | 22.0 | 100 |

HV3 has been carried out according to ISO 3878, transverse rupture strength according to ISO 3327, measurement of the elasticity module according to ISO 3312 and measurement of wear resistance according to CCPA (Cemented Carbide Producers Association) P-112.

As is obvious from the data of hardness above, an alloying according to the invention involves an increasing hardness compared with hard metal with not alloyed No-binderphase. The increase can be as high as +25% for a high alloying in the binder phase, which indicates a strong alloying hardening of the binder phase. The 2–9% better hardness of the invented alloy, even compared with corresponding WC-Co grades, can be explained by a higher alloying concentration in the binder phase.

The transverse rupture strength is a good estimate of toughness but only for comparisons between hard metals with the same E-module (the same composition and amount of hard material), which is obvious from the data above (compare transverse rupture strength with toughness (energy to breakage) and the fracture toughness parameter $K_{IC}$.) The great increase of transverse rupture strength, 31–37% increase, of the invented alloy compared with "not alloyed" WC-Ni shows that a strong improvement of the wetting between binder phase and hard material phase has been caused by the alloying. The difference of transverse rupture strength between hard metal with "not alloyed" Ni binder phase and hard metal with Co binder phase was of the same magnitude as is previously known. For an added concentration of 8–15 vol% of Cr+Mo (variants 2, 3, 6, 7 and 15) even an increase of the transverse rupture strength of 6–8% was obtained compared with WC-Co hard metal.

Variants 8, 12 and 17, in which deviating not identified phases have been obtained, showed an unfavourable toughness and also an unfavourable resistance to abrasive wear. This in spite of the fact that in some cases a favourable hardness was obtained. These results confirm the very good abrasive wear resistance of the tungsten carbide (WC) compared with other carbides.

EXAMPLE 2

Test specimens, which were produced according to Example 1 and with amount of the binder phase and composition of the binder phase according to variants 6, 7, 9, 13, 14, 15, 18 and 19, Example 1 have been corrosion tested. In order to get a general testimony of the corrosion resistance of hard metal grades, the tests have been carried out in a serial of buffer solutions with pH-values between 1 and 11. The buffer solutions have compositions according to Table 3 below.

TABLE 3

| pH | Solution | | |
|---|---|---|---|
| 1 | | 0.1 M HCl | |
| 2 | 350 ml | 0.1 M HCl + | 150 ml 0.1 M di-Sodium hydrogen citrate |
| 3 | 300 ml | 0.1 M HCl + | 200 ml 0.1 M di-Sodium hydrogen citrate |
| 4 | 225 ml | 0.1 M HCl + | 275 ml 0.1 M di-Sodium hydrogen citrate |
| 5 | | | 500 ml 0.1 M di-Sodium hydrogen citrate |
| 6 | 200 ml | 0.1 M NaOH + | 300 ml 0.1 M di-Sodium hydrogen citrate |
| 7 | 275 ml | 0.1 M $KH_2PO_4$ + | 175 ml 0.05 M $Na_2B_4O_7.10H_2O$ |
| 8 | 200 ml | 0.1 M $KH_2PO_4$ + | 250 ml 0.05 M $Na_2B_4O_7.10H_2O$ |
| 9 | 60 ml | 0.1 M $KH_2PO_4$ + | 390 ml 0.05 M $Na_2B_4O_7.10H_2O$ |
| 10 | 340 ml | 0.1 M $Na_2CO_3$ + | 110 ml 0.05 M $Na_2B_4O_7.10H_2O$ |
| 11 | 440 ml | 0.1 M $Na_2CO_3$ + | 12 ml 0.05 M $Na_2B_4O_7.10H_2O$ |

The corrosion tests were performed as immersion tests in the solutions above with a subsequent wear by SiC in alcohol in a porcelain mill. The subsequent wear was necessary to determine the total corrosion damage of the test specimens (i.e. to wear off areas of the specimen, where the binder phase had corroded away but the WC-skeleton was intact after the immersion test). Data of the immersion test:

Temperature:
26±1° C.
Time:
10 days
Number of specimens:
3/variant
Specimen:
Ground specimen ϕ9×15(mm)

Results of the corrosion tests have been plotted in diagrams, FIG. 1. As is obvious from the results, the amount of binder phase in the hard metal, for the same composition of the binder phase, has not affected the corrosion loss (A) more than the scatter between different specimens of the same composition variant (less than 15% of the mean value). In most cases a corrosion depth of 0.1 mm/year (D) is used as an upper limit for a material to be considered as corrosion resistant in a certain environment. A corrosion depth of 0.1 mm/year (D) corresponds to 36–42 mdd (=mg/24h×dm²) depending of the density of the hard metal variant.

As is obvious from the results of the tests, a WC-Co grade cannot be considered as corrosion resistant in environments of lower pH than 7. Exchange of the binder phase for "not alloyed" Ni-binder phase involves a certain decrease of the corrosion losses. The decrease can probably not be utilized practically except in very special applications (which partly explains the limited commercial use of the WC-Ni hard metal).

Additions of only 6 vol% Cr and 2 vol% Mo to the binder phase of the WC-Ni hard metal involved a drastic decrease of the corrosion losses. The hard metal was found to be corrosion resistant down to pH 3. An additional addition of Cr+Mo to the binder phase involved that a hard metal, corrosion resistant also at pH 1, could be obtained.

Thus, according to the invention, hard metal grades with mechanical properties well comparable with WC-Co grades and corrosion resistant down to pH 1, can be produced. This compared with the WC-Co grades which are corrosion resistant down to only pH 7.

EXAMPLE 3

The binder phase of sintered hard metal according to the invention has been analysed. The analyses were carried out partly with a high resolution, high sensitive microprobe analyser (Camebax from Camera, France) partly by so called phase separation and conventional chemical analysis.

Hard metal manufactured according to Example 1 and with compositions according to the variants 7, 8, 10, 11 and 13 in Example 1, has been analysed according to the methods mentioned above. The results are evident from Tables 4–6 below.

TABLE 4

Prepared composition of the hard metal (85 vol % WC - 15 vol % binder phase)

| Var | WC w/o | Ni w/o | Cr w/o | Mo w/o | Cu w/o | Optimal[x] $C_{tot}$-interval w/o |
|---|---|---|---|---|---|---|
| 7 | 91.00 | 7.77 | 0.81 | 0.42 | — | 5.51–5.65 |
| 8 | 91.00 | 6.64 | 1.11 | 1.25 | — | 5.55–5.67 |
| 10 | 91.10 | 5.59 | 1.55 | 0.94 | 0.64 | 5.56–5.68 |
| 11 | 91.20 | 7.70 | 1.10 | — | — | 5.52–5.66 |
| 13 | 90.90 | 9.10 | — | — | — | 5.41–5.59 |

[x]Total carbon concentration of sintered hard metal analysed by a gravimetric method. Intervals calculated by previously given expression.

TABLE 5

| | Prepared composition of binder phase | | | |
|---|---|---|---|---|
| Var | Ni w/o | Cr w/o | Mo w/o | Cu w/o |
| 7 | 86.3 | 9.0 | 4.7 | — |
| 8 | 73.8 | 12.3 | 13.9 | — |
| 10 | 64.8 | 17.4 | 10.6 | 7.2 |
| 11 | 87.5 | 12.5 | — | — |
| 13 | 100 | — | — | — |

TABLE 6

| | Results of analysis of binder phase | | | | | | | | | | | | | |
|---|---|---|---|---|---|---|---|---|---|---|---|---|---|---|
| | Ni | | Cr | | Mo | | Cu | | W | | Co | | Fe | |
| Var | w/o | vol % | w/o | vol % | w/o | vol % | w/o | vol % | w/o | vol % | w/o | vol % | w/o | vol % |
| 7 | 78.3 | 80.9 | 7.7 | 9.9 | 2.9 | 2.7 | — | — | 9.1 | 4.3 | 1.5 | 1.6 | 0.5 | 0.6 |
| 8 | 62.2 | 68.8 | 9.8 | 13.4 | 5.0 | 4.8 | — | | 21.1 | 10.8 | 1.3 | 1.5 | 0.6 | 0.7 |
| 10 | 59.9 | 61.5 | 15.2 | 19.3 | 6.1 | 5.5 | 6.4 | 6.5 | 10.2 | 4.8 | 1.6 | 1.7 | 0.6 | 0.7 |
| 11 | 75.0 | 78.5 | 10.1 | 13.1 | — | — | — | — | 12.9 | 6.2 | 1.4 | 1.5 | 0.6 | 0.7 |
| 13 | 88.1 | 93.4 | — | | — | — | — | — | 8.8 | 4.3 | 1.5 | 1.6 | 0.6 | 0.7 |

The results given above are mean values of the concentrations of each element, respectively, obtained by the two different analysis methods. The Ni concentration has not been determined, so also normally occurring impurities in hard metal are included in the Ni concentration above.

From the analyses above, it is evident that the added amount of Ni, Cr and Cu is almost completely dissolved in the binder phase of the sintered hard metal. The existing difference between prepared composition, Table 5, and analysed composition, Table 6, is due to a dilution of the binder phase by principally W from the hard material but also by Co and Fe from raw materials and production process. The analysis values of Cr can possibly indicate a slight dissolution in the carbide phase.

However, for Mo a significant difference between the analysed and the prepared composition exists, which cannot be explained by the dilution of the binder phase. Microprobe analysis of the carbide phase proved a dissolution of Mo in the carbide phase. For the variants 7 and 10 no new phases could be detected (detection limit: 0.1 μm). For variant 8, however, a new phase could be detected which contained principally W and Mo but also Cr. The particle size of this phase was up to 5 μm.

From the analysis values of tungsten in Table 6 it is evident, that principally Mo, but to a certain degree also Cr, increases the W-dissolution in the binder phase. The W-dissolution can be decreased by increased carbon concentration of the hard metal, but for the relatively high alloying concentrations such as in variant 10 (cf. var. 8) also Cu (or Al, Si, respectively) must be added to keep the W-concentration of the binder phase low and to avoid the formation of brittle, undesirable phases.

No brittle phases could be detected in variant 11 (the variant in which Mo was missing). From unfavourable toughness data, according to Example 1, of this variant, it is evident, that the natural reason for these values is that an alloying amount of Mo in carbide phase and binder phase is necessary to obtain the good toughness properties. As this variant has a good strenth (HV 3 in Example 1, cf. also var. 12) it is evident that the alloying hardening of the binder phase is due to principally the alloying amount of Cr.

EXAMPLE 4

Modern cutter suction dredgers which can dredge at bigger depths and with a bigger capacity have been developed. The big forces which are absorbed in pumps of these dredgers, cause great technical problems. Conventional high pressure pumps cannot be used because of the high demands, such as very abrasively wearing spoil materials, corrosion demands as the pumps often work in sea water and very high surface pressures, up to 2.5 MPa on a tightening surface of dimensions $\phi_i=440$, $\phi_o=460$ (mm) and a relative speed of 7–7.5 m/s. Exchange and repair of conventional pumps must be carried out as often as once a week.

The development of a new type of shaft seal for these pumps, performed as a plane tightening with hard metal rings as tightening elements, has been described in the 8th International Conference on Fluid sealing, University of Durham, England 1978, Mechanical face seal for big pressure dredge pump. E. Muddle and I. Wisser, pp. H3-19 to 34. Laboratory tests, carried out as conventional stick—against—ring tests, and tests carried out in a special test rig on full scale, showed that a hard metal grade with 30 vol% Co binder phase (variant 19, Example 1) and with a hardness of around HV 1000, appears to be optimal as has been described in the reference mentioned above. The grade was optimal concerning:

Strength (hardness) by the resistance to abrasive wear which was suited to;

Toughness, i.e. in this case resistance to the formation of thermal fatigue cracks due to high thermal stress.

In the test rig the corrosion demand together with the demand of strength and toughness could not be simulated in a satisfactory way. This resulted in a very strong wear of the hard metal rings in practical tests, a level wear of stator and rotor of around 5 mm, in all, after 3000 h testing time. Investigation of the tested rings proved relatively strong corrosion damages, as the dredging had been carried out in sea water.

To meet the demand of increased corrosion resistance, at the same time paying regard to the demands of the optimal strength and toughness of this application, hard metal according to variant 15, Example 1, was produced. Because this variant had the same carbide phase as the hard metal previously used and furthermore cobalt and nickel have nearly the same coefficients of thermal expansion, the fastening technique described in the reference could be used also for the hard metal rings of the new grade. Function tests in test rig were carried out and showed that no changes of the construction due to the change of grade were necessary. The seal rings of WC-NiCrMo were subsequently tested in practice in a dredger. After a testing time of 5000 h the pump was demounted for an overhaul. The level wear of the stator and rotor was less than 0.5 mm, in all. The leakage had been satisfactory for the whole testing time, i.e. less than 100 $cm^3/h$. After the overhaul the seal has been tested for 1500 h more without any faults.

EXAMPLE 5

In process industry, such as for paper pulp production, there are great demands for the corrosion resistance of construction parts. Acidproof constructions are extensively used. Furthermore the pulp is abrasively wearing. Thus, for shaft seals, bearings and applications of that kind, parts of hard metal are established products. Because of high demands for abrasive wear resistance and toughness, only hard metal of the type WC-Co has been appropriate. The demand for corrosion resistance has in these cases been solved with various success by placing sacrificial anodes near the hard metal part, or by constructions in which the hard metal is protected from the aggressive medium by water.

Previously, plane seals of a WC-8 vol% Co grade (a grade with physical and mechanical data according to variant 5, Example 1) have been used in a shaft seal of a pressure sieve for sieving sulphite lye. The pH of the sulphite lye varied between 3.5 and 3.9 and the temperature of the lye was 70°-90°0 C., and so sacrificial anodes of zinc were used to protect the plane seal. The life of the seal was unsatisfactory among other reasons due to demands for intense supervision of the construction, as the consumption of zinc anodes was high and varied strongly. A life of one to three months was normal : the plane seal and the life criterion was a strong leaka, Principally to decrease the need of maintenance the pressure sieve, which, except for the shaft seal, v made of acid proof construction, a shaft seal, in whi the sealing rings were made of WC-NiCrMo hard me with 8 vol% binder phase (production, compositi physical and mechanical data correspond to variant Example 1, i.e. composition of the binder phase: 85] 11Cr, 4Mo (added vol%)), was tested. No sacrific anodes were placed in the pressure sieve.

The shaft seal managed in continuous work foı months. The life criterion was leakage, which had be caused by abrasive wear by solid particles in the lye. exchange of the hard metal grade of the plane seal, 1 complete pressure sieve could successfully meet 1 corrosion resistance demands and the need of main nance was drasticaly decreased. Furthermore, an crease of life of the plane seal of 3 times was obtain

EXAMPLE 6

For production of low pressure polyethylene, util ing a high pressure process in the production, pisto alternatively cylinder linings, made of hard metal used in the high pressure compressors. The use of ha metal for these parts has involved an increase of life 15–30 times, but the greatest gain is the strongly creased cost of production stops and repairs. For pa for high pressure compressors, which have worki pressures of up to 3500 bars (350 MPa), there are hi demands for good properties of toughness and streng of the hard metal. To obtain these high pressures in 1 compressors and furthermore minimize time and co of maintenance, there are high demands for surfa smoothness (Ra=0.04) and exact size tolerances of 1 parts, and high demands for surface smoothness and s not being changed due to wear (in cooperation w other destruction mechanisms).

A hard metal with composition, physical and n chanical data according to variant 14, Example 1, WC-15 vol% Co with a mean grain size of WC 1.7–2.0 μm, has been used, with as a rule very go result, for pistons for high pressure compressors. Li of 5000–15000 h between each regrinding are of obtained. The possibility of regrinding the pistons of is an irremissible demand due to the high cost of aqu tion of the pistons, as they are made of hard metal.

In a certain type of process for polyethylene prod tion, however, the WC-Co grade mentioned above 1 not given satisfactory lives when used as piston in 1 high pressure compressor. After regrinding of the p ton, corrosion damages have been observed, in spite a regrinding depth of 0.1 mm. The reason for th strong corrosion attacks has not been possible to inve gate completely, but organic acids are probably form already in the high pressure compressor due to para reactions, not possible to control.

A piston of size $\phi 87 \times 1203$ mm was made of ha metal with composition, physical and metallograp data according to Example 1, variant 10, WC-15 vo (NiCrMoCu) with a mean grain size of WC of 1.7– μm. The surface smoothness of the piston was Ra=0 after finished polishing operation. After a testing time 8500 h the piston was demounted for inspection. defects could be discovered and so the piston was mounted in the high pressure compressor. The pis has now been tested for additional 1000 h without a faults.

EXAMPLE 7

The use of hard metal e.g. for cutters for wood work-ng compared with the use of cutters of conventional ype of material, high speed steel, has involved a reduc-ion of tool costs of up to 75%.

However, in working of damp wood, degree of mois-ure more than 20% and pH max. 5, conventional VC-Co grades cannot be used because of inadequate :orrosion resistance. The greatest corrosion problems .rise in working of oak, cedar and chestnut, which in noist state evaporate mainly acetic acid but also formic .cid, oxalic acid and citric acid to air.

To get a hard metal grade for working of damp vood, technological tests were carried out. Working ests were performed in moist oak, which had been tored in a relative humidity of 80% and with an .nalysed concentration of acetic acid of 0.90%. A vorking operation was performed as a milling opera-ion. The mill was mounted with plane indexable inserts ıf dimension 50×12×1.5 mm with 45° angle of clear-.nce. 3 indexable inserts, 2 edges per insert, were tested ıer composition variant for 1000 running meters. To :stablish the quality of the edges, surface condition tests n dry birch were milled after 200 m and 1000 m. In each nilled piece of wood a measurement of the surface moothness was made. The hard metal inserts were veighed before and after the testing to determine the oss of weight due to wear in connection with corro-ion. The results given below are mean values of six ested edges:

| Variant | Composition of binder phase (prepared) vol % | Max. value of surface deviation $R_{max}$ (μm) Milled, running meters 200 m | 1000 m | Loss of weight after 1000 m (mg) |
|---|---|---|---|---|
| 7 | 85Ni 11Cr 4 Mo | 35 | 30 | 1.5 |
| 8 | 73Ni 15Cr 12Mo | 85 | 95 | 9.0 |
| 9 | 73Ni 19Cr 6Mo 2Al | 30 | 30 | 1.3 |
| 14 | 100 Co | 0 | 75 | 12.4 |

The great loss of weight which was obtained for 'ariant 8, with a high concentration of molybdenum .nd a relatively bad toughness (cf. Example 1) was due o tear of the edge. This tear resulted in big surface leviations in the surface smoothness test which is evi-lent from the table above. The corrosion of the WC-Co ;rade resulted in the biggest loss of weight of the tested ;rades and furthermore unfavourable surface deviations n the worked surface.

Additional practical tests have confirmed that the 'ariants no. 7 and no. 9 gave very good results in work-ng of damp wood. By the very good corrosion resis-ance in combination with the good properties of tough-ıess and strength of these grades, hard metal can as a ule be used in the field of wood working with drasticly lecreased costs of tools as result.

EXAMPLE 8

Conventional WC-Co hard metal cannot be used in ıot rolling of copper because of a strong galvanic cor-osion of the binder phase. Practical tests, e.g. in a Pro-ıertzi-work, in which rollers of high-speed steel previ-ıusly have been used, have been carried out for conven-ional hard metal grades without obtaining an improved production result between the regrindings. The crite-rion of regrinding was a bad surface of the copper wire.

By laboratory tests, simulating the high thermal stresses and the high demands for corrosion resistance present in hot rolling of copper wire, a new hard metal grade was made. Composition: WC-25 vol% binder phase, the mean grain size of the carbide phase was 3.5 μm, prepared composition of the binder phase: 65Ni, 20Cr, 6Mo, 5Cu, 4Mn (vol%), carbon concentration of sintered hard metal: 5.23 w/o C (in powder added con-centration: 5.35 w/o C). The transverse rupture strength was measured 3000 N/mm2 and the hardness according to HV3 was 1050. The preparation of this hard metal was carried out analogously to the variants of Example 1 with a milling time of 160 h and a sintering temperature of 1450° C., the time at 1450° C. was for 1 h.

The developed hard metal grade was tested in rollers in the Propertzi-work mentioned above. For rolling of copper wire of a final dimension ϕ6.35 mm, 19 reduc-tion steps are used in the rolling mill. Three rollers were included in each reduction step. For the two last reduc-tion steps rollers of a hard metal according to the inven-tion were used.

For the other reduction steps the rollers were made of the highspeed steel grade previously used. The num-ber of tons which were produced between regrinding of the rollers of the final pair was 300 tons for high-speed rollers in the last reduction step. This corresponds to the production of three shifts. The hard metal rollers could manage 2200 tons before the surface of the produced copper wire required a regrinding of the rollers. An investigation of the tested rollers showed that the sur-face of the roll groove contained thermal fatigue cracks as for rollers of previously tested conventional hard metal of WC-Co type. On the contrary the surface of the roll groove contained no corrosion damages, often as pits in connection with the thermal fatigue cracks, which had been observed for WC-Co hard metal rollers previously tested.

To inhibit the higher cost of aquisition of hard metal rollers, compared with the high-speed steel rollers pre-viously used, the hard metal rollers must produce be-tween 900 and 1200 tons of wire between each regrind-ing which according to the facts above definitely can be obtained with rollers made of the alloy according to the present invention.

I claim:

1. Sintered hard metal alloy of high wear resistance combined with good toughness properties, good strength and excellent corrosion and oxidation resis-tances, said alloy consisting essentially of from 55–95% by volume hard materials of which at least 98% is WC, remainder being one or more carbides of the metals Ti, Zr, Hf, V, Nb and Ta and from 5 to 45% by volume of a single phase binder, said single phase binder consisting essentially of, in % by volume:

Ni: at least 50
Cr: 10–25
Mo: 3–15
Mn: 10 max.
Co: 30 max.
Fe: 20 max.
W: 13 max.

and one or more of:

Al: 0.5–5.0
Si: 0.5–5.0
Cu: 0.5–10 and a total carbon concentration (weight percent, or w/o, C) in the sintered alloy of:

w/o $C = A_i - B_i$ (100 minus w/o hard material)

wherein $A_i = 1/100$ (w/o WC in hard material $\times 6.13 +$ w/o TaC in hard material $\times 6.22 +$ w/o VC in hard material $\times 19.08$)

and $B_i = 0.061 \pm 0.008$ for Cr+Mo between 13–15 volume % and $B_i = 0.058 \pm 0.007$ for Cr+Mo between 16–35 volume %.

2. The sintered hard metal alloy of claim 1, wherein said single phase binder contains up to 20% Cr and up to 6% Mo.

3. The sintered hard metal alloy of claim 1, wherein the hard material is essentially all WC.

4. The sintered hard metal of claim 3, wherein the single phase binder contains Cr+Mo in an amount of between 13 and 15 volume percent.

5. The sintered hard metal of claim 3, wherein the single phase binder contains Cr+Mo in an amount of between 16 and 35 volume percent.

* * * * *